United States Patent [19]

Margotteau

[11] Patent Number: 5,054,634

[45] Date of Patent: Oct. 8, 1991

[54] CAPSULE WITH A DRAWER AND A SLIDING CURSOR

[75] Inventor: Jacques Margotteau, La Grande Motte, France

[73] Assignee: Societe de Conseils et d'Etudes de Emballages - S.C.E.E., Seine er Marne, France

[21] Appl. No.: 607,436

[22] Filed: Feb. 21, 1989

[51] Int. Cl.[5] ..... B65D 43/12

[52] U.S. Cl. ..... 215/322; 220/345; 220/350; 220/351; 222/531; 222/532; 222/537; 222/545

[58] Field of Search ..... 215/322; 220/345, 350, 220/351; 222/531, 532, 537, 545

[56] References Cited

U.S. PATENT DOCUMENTS

| | | | |
|---|---|---|---|
| 1,800,774 | 4/1931 | Bosecker | 222/545 |
| 1,851,065 | 3/1932 | Roselle | 222/545 |
| 1,901,413 | 3/1933 | Roselle | 222/545 |
| 2,839,228 | 6/1958 | Levine | 222/537 |
| 2,851,204 | 9/1958 | Schwab | 222/545 |

FOREIGN PATENT DOCUMENTS

| | | | |
|---|---|---|---|
| 466986 | 10/1928 | Fed. Rep. of Germany | 220/345 |
| 1485950 | 6/1967 | France . | |
| 2233248 | 1/1975 | France . | |
| 2504500 | 10/1982 | France . | |
| 8908058 | 9/1989 | World Int. Prop. O. | 222/532 |

*Primary Examiner*—Stephen Marcus
*Assistant Examiner*—Stephen Cronin
*Attorney, Agent, or Firm*—Browdy and Neimark

[57] ABSTRACT

The capsule has a capsule body provided for closing one end of a container. The capsule body includes a top wall formed with a port and from which is formed a slide for a drawer covered by a top of an envelope fixedly connected to the capsule body and formed with an incision for a control knob. The control knob controls the drawer and is associated with a cursor closing the incision.

11 Claims, 1 Drawing Sheet

CAPSULE WITH A DRAWER AND A SLIDING CURSOR

FIELD OF THE INVENTION

This invention relates to capsules adapted for being placed on containers such as flasks so as to provide a tight closing and an opening of these flasks without having to remove the capsule.

BACKGROUND OF THE INVENTION

Prior art has taught various types of capsules of the hereabove mentioned type and typically capsules formed with a pivoting closing spout or including a shutter vertically mobile when the envelope of the capsule is rotated according to a determined angle.

Some of the hereabove mentioned capsules give full satisfaction but do not make possible for the product contained in the container to be poured through the side wall of the capsule.

OBJECT OF THE INVENTION

The present invention has for an object to provide a new capsule making possible to pour a content of the container through its side wall whatever is the shape of the capsule, while providing a tight closing of the container, and this by a simple displacement of a control knob accessible from an outside of the capsule and operable with respect to the capsule without a visible opening of a portion of the capsule resulting therefrom.

SUMMARY OF THE INVENTION

According to the invention, the capsule has a capsule body provided for closing an end of a container, the capsule body includes a top wall formed with a port and from which is formed a slide for a drawer covered by a top of an envelope fixedly connected to the capsule body and formed with an incision for a control knob, the control knob controlling the drawer and being associated with a cursor closing the incision.

Various other features of the invention will become more apparent from the hereafter detailed description.

BRIEF DESCRIPTION OF THE DRAWINGS

An embodiment of the invention is shown by way of a non limiting example in the accompanying drawings, wherein.

DESCRIPTION OF A PREFERRED EMBODIMENT

Figure 1:
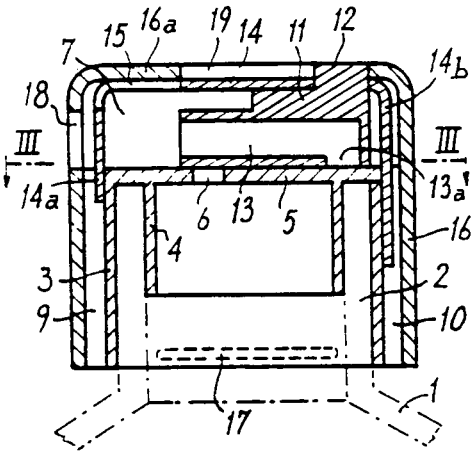
FIG. 1 is an elevation sectional view of an embodiment of the invention.

The capsule shown in the drawings is intended for being placed on a container 1, for example a flask, which is shown schematically in phantom in FIG. 1.

The container 1 has a neck 2 on which is mounted a capsule body 3. The body 3 can be connected to the container 1 by an appropriate means, for example : by an outer and an inner screw threads, by snap-in means or by any other suitable convenient means known in the art.

Although this it not necessary in all cases, the body 3 is advantageously formed with a sealing skirt 4 extending inside the neck 2 and bearing against an inner wall of the neck 2.

The body 3 is closed at its top by a wall 5 in which is formed a port 6.

The body 3 forms, also at its top, a slide 7 defining a transverse passage 8 communicating with side notches 9, 10.

The slide 7 is used for guiding a drawer 11 defining a control knob 12 preferably formed in a vicinity of one of the ends of the drawer 11.

Figure 2:
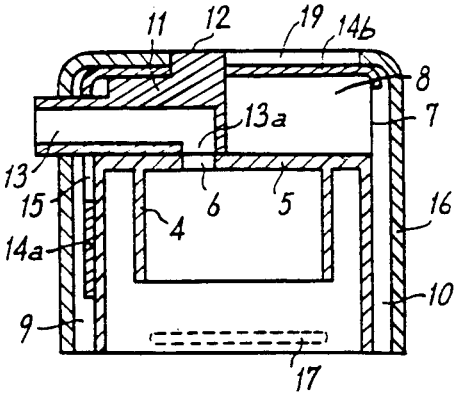
FIG. 2 is an elevation sectional view similar to FIG. 1, showing a characteristic position of a drawer shown in the capsule of FIG. 1.
Figure 3:
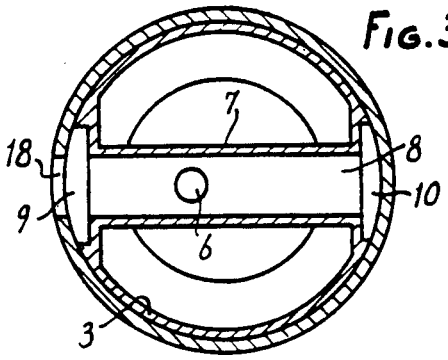
FIG. 3 is a sectional view taken along line III—III of FIG. 1.
Figure 4:
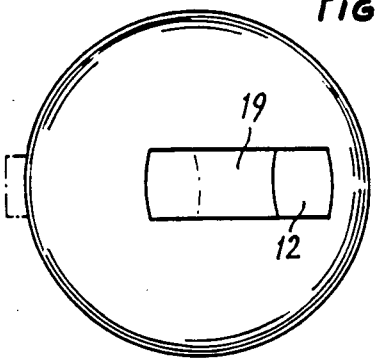
FIG. 4 is a view from above of FIG. 1.
Figure 5:
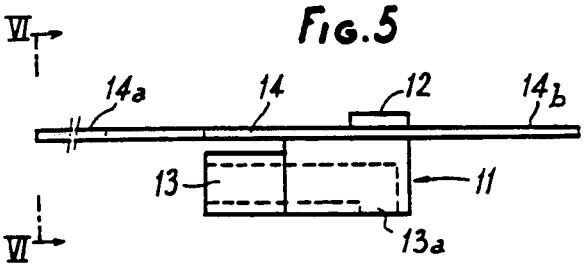
FIG. 5 is an side elevation view of the drawer and cursor of the capsule.
Figure 6:
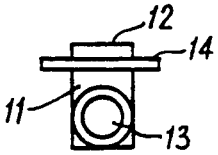
FIG. 6 is an elevation view from line VI—VI of FIG. 5.
Figure 7:
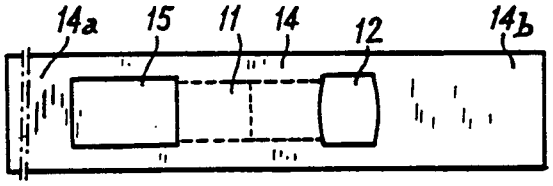
FIG. 7 is a view from above of FIG. 5.

The drawer 11 has a longitudinal passage 13 and an opening **13*a* normally closed by the wall 5 of the body 3 as shown in FIG. 1, but which can also be brought in register with the port 6 as shown in FIG. 2**.

The drawer 11 includes at its top a flexible cursor 14 having an anterior portion **14*a* and a posterior portion 14*b*. The anterior portion 14*a* of the cursor 14 is formed, on a part of its length, with an opening 15 the width of which is at least equal to that of the anterior portion of the drawer 11**.

The cursor 14 can be attached to the drawer 11, for example encased on the control knob 12, or it can be made integral with drawer 11, this being easily executed by a moulding by injection of the thermoplastics material, such as polyethylene or polyamide.

The assembly formed by the body 3, drawer 11 and cursor 14 is covered by an envelope 16 which is mounted onto the body 3 and latched thereon by an appropriate means such as a circlip 17.

The drawing shows the way the drawer 11 and consequently the cursor 14 are held in position in the transverse passage 8 of the slide 7 by the envelope 16.

The length of the anterior portion **14*a* of the cursor 14 is chosen in such manner that it closes a hole 18 of the envelope 16 when the drawer 11 is in a position in which the opening 13*a* is offset with respect to the port 6**.

Actually, in this position, an end of the anterior portion **14*a* of the cursor 14 is bent and engaged inside the notch 9 defined by the body 3 and envelope 16**.

In a similar way, the posterior portion **14*b* of the cursor 14 is bent and engaged inside the notch 10 defined by the body 3 of the envelope 16. The opening 15 of the cursor 14 is on the other hand below the top 16*a* of the envelope 16 and consequently an incision 19 formed in the top 16*a* of the envelope 16 is closed by the cursor 14**.

When it is desired to use the product contained in the container 1, one acts on the control knob 12 so as to displace the control knob 12 within the incision 19 to the position shown in FIG. 2.

The effect of the movement of the control knob 12 is to displace the drawer 11 and the cursor 14, the opening 15 of which comes progessively in register with the hole 18 of the envelope 16 for enabling an anterior end of the drawer 11 to extend first through the opening 15, then through the hole 18 by protruding beyond the envelope 16.

In this position, shown in FIG. 1, the port 6 is in register with the opening **13*a* of the longidutinal passage 13 of the drawer 11**.

FIG. 2 shows that in the opened position, the posterior portion 14*b* of the cursor 14 closes the incision 19 so that the inside of the envelope 16 is constantly isolated from the outside whatever is the position of the drawer 11.

The invention is not limited to the embodiment shown and described in detail and any modifications thereof can be carried out thereto without departing from the scope of the invention as shown in the appendant claims.

In particular, the body 3 and envelope 16 can also be made by a moulding by injection of thermoplastics materials. The nature of these materials can be different to that used for making the cursor and the drawer. In any case, the constituent materials at least of the cursor have to be chosen amongst those having a good resiliency in order to permit a displacement and a resilient deformation of the anterior 14*a* and posterior 14*b*portions.

What is claimed is:

1. A capsule with a sliding drawer for a container, has a capsule body provided for closing one end of the container, the capsule body includes a top wall formed with a port and from which is formed a slide for a drawer cover by a top of an envelope fixedly connected to the capsule body and formed with an incision for a control knob, said control knob controlling the drawer and being associated with a cursor for closing said incision, and wherein said cursor includes a posterior portion for closing the incision of the envelope when said drawer is placed in a position in which it protrudes through an opening of the cursor and a hole of the envelope at the same time as an opening of a longitudinal passage of said drawer is brought in register with the port of said capsule body.

2. A capsule as set forth in claim 1, wherein the slide has a transverse passage and the envelope is formed with a hole, said hole being in register with the transverse passage of the slide, and wherein said cursor includes an anterior portion for closing said hole.

3. A capsule as set forth in claim 2, wherein the drawer has an anterior portion, and wherein the anterior portion of the cursor is formed with an opening brought in register with the hole of the envelope for passage of the anterior portion of the drawer.

4. A capsule as set forth in claim 1, wherein the cursor has anterior and posterior portions, and wherein notches are formed between the capsule body and the envelope, said notches, housing and guiding the anterior and posterior portions of the cursor.

5. A capsule as set forth in claim 11, wherein the cursor is made of a resilient flexible material.

6. A capsule as set forth in claim 11, wherein the cursor is made integral with the drawer.

7. A capsule as set forth in claim 11, wherein the envelope is fixed on the capsule body (3) by latching means.

8. A capsule as set forth in claim 7, wherein said latching means comprises a circlip.

9. A capsule as set forth in claim 11, wherein the capsule body, the drawer and the cursor are made by moulding by injection of thermoplastics materials.

10. A capsule as set forth in claim 9, wherein said thermoplastics materials comprise polyethylene.

11. A capsule as set forth in claim 9, wherein said materials comprise polyamide.

* * * * *

UNITED STATES PATENT AND TRADEMARK OFFICE

CERTIFICATE OF CORRECTION

PATENT NO. : 5,054,634

DATED : October 8, 1991

INVENTOR(S) : Jacques MARGOTTEAU

It is certified that error appears in the above-identified patent and that said Letters Patent is hereby corrected as shown below:

On the title page: insert the following:

-- [30] Foreign Application Priority Data

Mar. 01, 1988 [FR] France.....88 02549 --

Signed and Sealed this

Sixth Day of April, 1993

*Attest:*

STEPHEN G. KUNIN

*Attesting Officer*

*Acting Commissioner of Patents and Trademarks*